US010762814B2

(12) United States Patent
Hu et al.

(10) Patent No.: US 10,762,814 B2
(45) Date of Patent: Sep. 1, 2020

(54) DISPLAY PANEL AND TESTING METHOD THEREOF, DISPLAY DEVICE

(71) Applicants: Hefei Xinsheng Optoelectronics Technology Co., Ltd., Hefei, Anhui (CN); BOE Technology Group Co., Ltd., Beijing (CN)

(72) Inventors: Qi Hu, Beijing (CN); Hui Jing, Beijing (CN); Weijing Liao, Beijing (CN)

(73) Assignees: HEFEI XINSHENG OPTOELECTRONICS TECHNOLOGY CO., LTD., Hefei, Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/450,161

(22) Filed: Jun. 24, 2019

(65) Prior Publication Data

US 2020/0005692 A1 Jan. 2, 2020

(30) Foreign Application Priority Data

Jul. 2, 2018 (CN) ..... 2018 1 0708261

(51) Int. Cl.

| | |
|---|---|
| ***G09G 3/00*** | (2006.01) |
| ***G09G 3/3266*** | (2016.01) |
| ***G09G 3/3291*** | (2016.01) |

(52) U.S. Cl.

CPC ..... *G09G 3/006* (2013.01); *G09G 3/3266* (2013.01); *G09G 3/3291* (2013.01); *G09G 2300/043* (2013.01); *G09G 2300/0426* (2013.01); *G09G 2300/0452* (2013.01)

(58) Field of Classification Search

CPC .... G09G 3/3225; G09G 3/006; G09G 3/3266; G09G 3/3291; G09G 3/3233; G09G 2300/0426; G09G 2300/043; G09G 2300/0819; G09G 2300/0452; G09G 2300/0842; G09G 2320/066

See application file for complete search history.

(56) References Cited

U.S. PATENT DOCUMENTS

| | | | | |
|---|---|---|---|---|
| 2014/0022289 | A1* | 1/2014 | Lee | G09G 3/006 345/691 |
| 2016/0155381 | A1* | 6/2016 | Kwon | G09G 3/3233 345/215 |
| 2017/0004776 | A1* | 1/2017 | Park | G09G 3/3208 |
| 2020/0013341 | A1* | 1/2020 | Kim | G09G 3/3233 |

* cited by examiner

*Primary Examiner* — Christopher E Leiby
(74) *Attorney, Agent, or Firm* — Nath, Goldberg & Meyer; Joshua B. Goldberg

(57) ABSTRACT

A display panel and a testing method thereof, a display device are provided. The display panel includes a plurality of data lines and a plurality of test signal lines, an even number of adjacent data lines are grouped as a data line group, one test signal line is provided at a middle position of the data line group, a plurality of data line groups are in one-to-one correspondence with the plurality of test signal lines, each of the plurality of test signal lines includes a first extending part and a plurality of second extending parts coupled to the first extending part, and each of the second extending parts extends symmetrically at both sides of the first extending part.

18 Claims, 5 Drawing Sheets

DISPLAY PANEL AND TESTING METHOD THEREOF, DISPLAY DEVICE

CROSS-REFERENCE TO RELATED APPLICATION

The present application claims the priority of the Chinese Patent Application No. 201810708261.7, entitled "Display Panel and Testing Method Thereof and Test Module, Display Device", filed at the Chinese National Intellectual Property Administration on Jul. 2, 2018, the disclosed contents of which are incorporated herein in their entirety by reference.

TECHNICAL FIELD

The present disclosure relates to the field of display technology, and in particular, relates to a display panel, a method for testing the display panel, and a display device including the display panel.

BACKGROUND

As the display technology becomes mature increasingly, quality of a display panel relates to strength of competitiveness of the panel developer.

In order to achieve narrow bezel, a gate drive circuit including multistage shift register units is generally employed to sequentially scan multiple rows of pixel units of the display panel row by row.

SUMMARY

According to an aspect of the present disclosure, is the present disclosure provides a display panel, including a plurality of gate lines, a plurality of data lines, a plurality of test signal lines, and a plurality of pixel units, in which the plurality of pixel units are provided in regions arranged in rows and columns formed by intercrossing of the plurality of gate lines and the plurality of data lines, and each of the plurality of pixel units includes an organic light emitting diode (OLED), an even number of adjacent data lines among the plurality of data lines are grouped as a data line group such that the plurality of data lines are grouped as a plurality of data line groups, one test signal line is provided at a middle position of the data line group such that the numbers of data lines at both sides of the test signal line are same, the plurality of test signal lines are provided at a different layer of the display panel than the plurality of data lines, and the plurality of data line groups are in one-to-one correspondence with the plurality of test signal lines, each of the plurality of test signal lines includes one first extending part and a plurality of second extending parts coupled to the first extending part; the first extending part extends along a first direction parallel to the plurality of data lines; each of the second extending parts extends symmetrically at both sides of the first extending part along a second direction perpendicular to the first direction, to electrically connect to anodes of OLEDs of a row of pixel units corresponding to the data line group, and an orthographic projection of each of the second extending parts on a layer where the plurality of data lines are located has overlapping regions that overlap with each data line in the data line group.

According to an embodiment of the present disclosure, an overlapping region of each second extending part at a first side of the first extending part has an area equal to an area of an overlapping region at a symmetrical position at a second side of the first extending part.

According to an embodiment of the present disclosure, the overlapping regions of each second extending part overlapping with data lines of the data line group have equal areas.

According to an embodiment of the present disclosure, the number of the plurality of second extending parts is equal to the number of the plurality of gate lines.

According to an embodiment of the present disclosure, the plurality of second extending parts and the plurality of gate lines are provided at different layers of the display panel, and the plurality of second extending parts have orthographic projections on the layer where the plurality of gate lines are located which overlap with the plurality of gate lines in one-to-one correspondence.

According to an embodiment of the present disclosure, the display panel further includes a plurality of test scan lines and a plurality of test switch circuits arranged in rows and columns and provided in one-to-one correspondence with the plurality of pixel units, wherein the plurality of test scan lines are arranged parallel to the plurality of gate lines and one test scan line is configured to drive a row of test switch circuits, in which each of the test switch circuits includes a control terminal, an input terminal, and an output terminal, the control terminal of the test switch circuit is electrically coupled to a corresponding test scan line, the input terminal of the test switch circuit is electrically coupled to an anode of an OLED of a corresponding pixel unit, and the output terminal of the test switch circuit is electrically coupled to a second extending part of a test signal line corresponding to a data line group to which a data line coupled to the corresponding pixel unit belongs.

According to an embodiment of the present disclosure, each of the test switch circuits includes a test switch transistor, a first electrode of the test switch transistor corresponds to the output terminal and is coupled to the second extending part of the corresponding test signal line, a second electrode of the test switch transistor corresponds to the input terminal and is coupled to the anode of the OLED of the corresponding pixel unit, and a gate of the test switch transistor corresponds to the control terminal and is coupled to the corresponding test scan line.

According to an embodiment of the present disclosure, the display panel further includes a plurality of sensing capacitors, the plurality of sensing capacitors are provided in one-to-one correspondence with the plurality of test signal lines, and a first terminal of the sensing capacitor is coupled to the corresponding test signal line, and a second terminal of the sensing capacitor is grounded.

According to an embodiment of the present disclosure, each of the pixel units is provided with a compensation circuit, which includes a data switch transistor, a drive transistor, a storage capacitor, a first electric level signal terminal and a second electric level signal terminal, a first electrode of the data switch transistor is coupled to a data line corresponding to a pixel unit to which it belongs, a gate of the data switch transistor is coupled to a gate line corresponding to the pixel unit to which it belongs, and a second electrode of the data switch transistor is coupled to a gate of the drive transistor and a first terminal of the storage capacitor, respectively; a first electrode of the drive transistor is coupled to the first electric level signal terminal, a second electrode of the drive transistor is coupled to an anode of an OLED of the pixel unit to which it belongs and a second terminal of the storage capacitor, respectively; the second electric level signal terminal is coupled to a cathode of the OLED.

According to an embodiment of the present disclosure, the number of the plurality second extending parts is equal to the number of the plurality of test scan lines, the plurality of second extending parts are provided at a different layer of the display panel than the plurality of test scan lines, and orthographic projections of the plurality of second extending parts on a layer where the plurality of test scan lines are located overlap with the plurality of test scan lines in one-to-one correspondence.

According to an embodiment of the present disclosure, the plurality of data lines are grouped according to colors of the pixel units.

According to an embodiment of the present disclosure, the pixel units include a red pixel unit, a green pixel unit, a blue pixel unit, and a white pixel unit, which are coupled to four data lines in one data line group, respectively.

According to another aspect of the present disclosure, is the present disclosure provides a testing method of a display panel, wherein the display panel includes: a plurality of gate lines, a plurality of data lines, a plurality of test signal lines, and a plurality of pixel units, wherein the plurality of pixel units are provided in regions arranged in rows and columns formed by intercrossing of the plurality of gate lines and the plurality of data lines, and each of the plurality of pixel units includes an organic light emitting diode (OLED), wherein an even number of adjacent data lines among the plurality of data lines are grouped as a data line group such that the plurality of data lines are grouped as a plurality of data line groups, one test signal line is provided at a middle position of the data line group such that the numbers of data lines at both sides of the test signal line are same, the plurality of test signal lines are provided at a different layer of the display panel than the plurality of data lines, and the plurality of data line groups are in one-to-one correspondence with the plurality of test signal lines, each of the plurality of test signal lines includes a first extending part and a plurality of second extending parts coupled to the first extending part; the first extending part extends along a first direction parallel to the plurality of data lines; each of the second extending parts extends symmetrically at both sides of the first extending part along a second direction perpendicular to the first direction, to electrically connect to anodes of OLEDs of a row of pixel units corresponding to the data line group, and an orthographic projection of each of the second extending parts on a layer where the plurality of data lines are located has overlapping regions that overlap with each data line in the data line group, the testing method includes a plurality of test cycles, a test time period of each of the test cycles includes a plurality of test stages, the plurality of test stages test, in one-to-one correspondence, respective ones of pixel units corresponding to data lines in the data line group, wherein, in each test stage, an anode of an OLED in a pixel unit to be tested is kept being electrically coupled to a corresponding test signal line, data lines in the data line group except for both a data line corresponding to the pixel unit to be tested and an offset data line are kept being supplied with zero voltage, wherein the offset data line is a data line in the data line group used for offsetting a voltage on the data line corresponding to the pixel unit to be tested, each of the test stages includes: a first initialization sub-stage, supplying the data line corresponding to the pixel unit to be tested and the corresponding test signal line with zero voltage to initialize the pixel unit to be tested, while supplying the offset data line with a test voltage; a second initialization sub-stage, supplying the data line corresponding to the pixel unit to be tested with the test voltage and keeping the corresponding test signal line being supplied with zero voltage while storing electric energy, while supplying the offset data line with zero voltage; a test sub-stage, cutting off connection between the pixel unit to be tested and the corresponding data line, stopping the corresponding test signal line being supplied with zero voltage, and testing a voltage at the anode of the OLED in the pixel unit to be tested using the stored electric energy, by the test signal line coupled to the anode of OLED of the pixel unit to be tested.

According to an embodiment of the present disclosure, an overlapping region of each second extending part at a first side of the first extending part has an area equal to an area of an overlapping region at a symmetrical position at a second side of the first extending part, and the offset data line is a data line in the data line group located at a symmetrical position about the first extending part of the test signal line corresponding to the data line group, relative to the data line corresponding to the pixel unit to be tested.

According to an embodiment of the present disclosure, overlapping regions of each second extending part overlapping with data lines of the data line group have equal areas, and the offset data line is any data line in the data line group other than the data line corresponding to the pixel unit to be tested.

According to still an aspect of the present disclosure, is the present disclosure provides a display device, including the display panel described above, the display device further including a source drive circuit, a gate drive circuit, and a controller, wherein the controller is electrically coupled to the plurality of test signal lines, the source drive circuit and the gate drive circuit; the source drive circuit is coupled to the plurality of pixel units on the display panel via the plurality of data lines; the gate drive circuit is coupled to the plurality of pixel units on the display panel via the plurality of gate lines.

According to an embodiment of the present disclosure, the display device further includes a tester and a first switch, wherein the tester is coupled to first extending parts of the plurality of test signal lines via the first switch, and the tester is further coupled to the controller.

According to an embodiment of the present disclosure, the display device further includes a test signal source and a second switch, wherein the test signal source is coupled to the first extending parts of the plurality of test signal lines via the second switch.

BRIEF DESCRIPTION OF THE DRAWINGS

The accompanying drawings, which constitute a part of the specification, are provided for further understanding of the present disclosure, and for explaining the present disclosure along with the following specific implementations, but not intended to limit the present disclosure, in which.

DETAILED DESCRIPTION

Exemplary embodiments of the present disclosure will be described in detail below in conjunction with the accompanying drawings. It should be understood that the exemplary embodiments described herein are presented solely for the purpose of explaining and interpreting the present disclosure rather than limiting the present disclosure.

In the related art, a test signal line is used for testing a pixel unit, and then a compensation signal is generated to compensate for the display panel. In order to improve aperture ratio of the display panel, in general, the test signal line is arranged to overlap with data lines, and the test signal line and the data lines are provided in different layers. However, such a compensation method still has a problem of color deviation. Research has found that the reason for inaccurate compensation in the related art lies in that overlapping of the data lines with the test signal line causes generation of parasitic capacitance, which causes errors in data detected from different screens.

In view of this, as an aspect of the present disclosure, a display panel is provided. The display panel includes a plurality of gate lines, a plurality of data lines, a plurality of test signal lines, and a plurality of pixel units. The plurality of pixel units are provided in regions arranged in rows and columns formed by intersection between the plurality of gate lines and the plurality of data lines. Each of the plurality of pixel units includes a light emitting element. In the present disclosure, description is given in an example where the light emitting element is an organic light emitting diode (OLED).

An even number of adjacent data lines (for example, 4 adjacent data lines) among the plurality of data lines are grouped as a data line group. A test signal line 10 is provided at a middle position of the data line group, such that the numbers of data lines at both sides of the test signal line 10 are same. A plurality of test signal lines 10 and the plurality of data lines are provided at different layers of the display panel, and a plurality of data line groups are in one-to-one correspondence with the plurality of test signal lines 10. Each of the plurality of test signal lines 10 includes a first extending part 130 and a plurality of second extending parts coupled to the first extending part 130.

The first extending part 130 extends along a first direction parallel to the plurality of data lines. Each of the second extending parts extends symmetrically at both sides of the first extending part 130 along a second direction perpendicular to the first direction, to be electrically coupled to anodes of OLEDs of a row of pixel units corresponding to the data line group, and an orthographic projection of each of the second extending parts on the layer where the plurality of data lines are located has an overlapping region that overlaps with each data line in the data line group.

Figure 6:
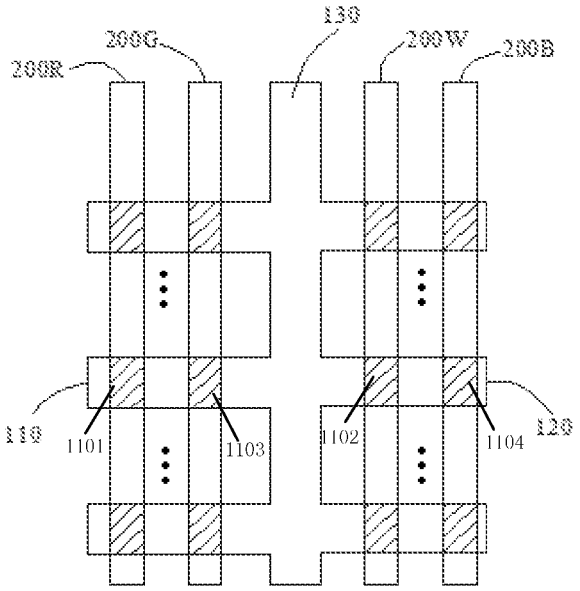
FIG. 6 is a schematic diagram of a test signal line in a display panel provided according to an embodiment of the present disclosure.

As shown in FIG. 6, the test signal line 10 includes one first extending part 130 and a plurality of second extending parts. The first extending part 130 extends along a direction parallel to the extending direction of a data line 200R, a data line 200G, a data line 200W, and a data line 200B (the first direction). The plurality of second extending parts extend along a second direction perpendicular to the first direction. For ease of description, the second extending part is divided into a first offset part 110 and a second offset part 120, and the first offset part 110 and the second offset part 120 constitute the second extending part. The first extending part 130 of the test signal line 10 is located in the middle of an even number of data lines, i.e. a data line 200R, a data line 200G, a data line 200W, and a data line 200B, such that the same number of data lines are at both sides of the test signal line 10. Each of the second extending parts is electrically coupled to anodes of OLEDs of a row of pixel units of the data line group corresponding thereto.

Figure 1:
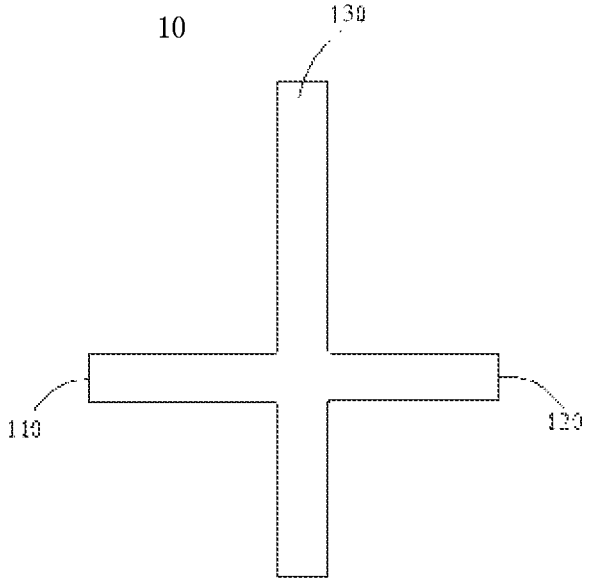
FIG. 1 is a schematic diagram of a test signal line in a display panel provided according to an embodiment of the present disclosure.

FIG. 1 illustrates a test signal line 10 having one second extending part, and the second extending part consisting of the first offset part 110 and the second offset part 120 crosses with the first extending part 130.

Figure 2:
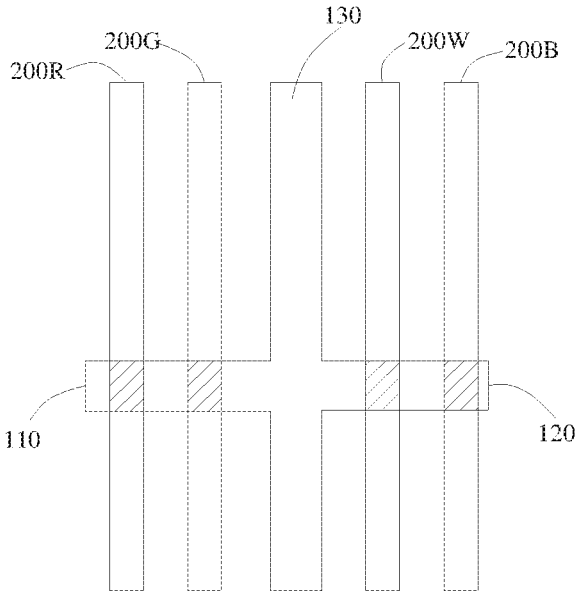
FIG. 2 is a schematic diagram showing position relationship between a test signal line corresponding to a data line group and data lines of the data line group in a display panel provided according to an embodiment of the present disclosure.
Figure 3A:
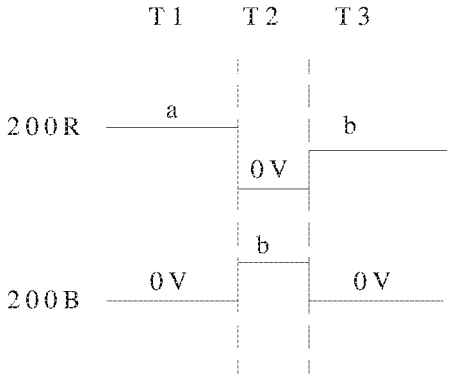
FIGS. 3(*a*) to 3(*d*) are timing diagrams of signals for testing a pixel unit in a display panel provided according to an embodiment of the present disclosure.
Figure 3B:
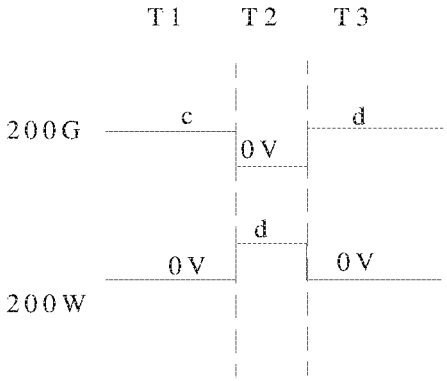
Figure 3C:
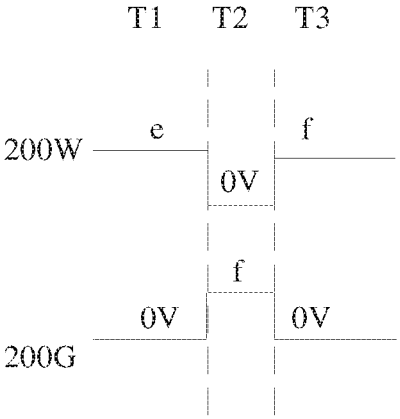
Figure 3D:
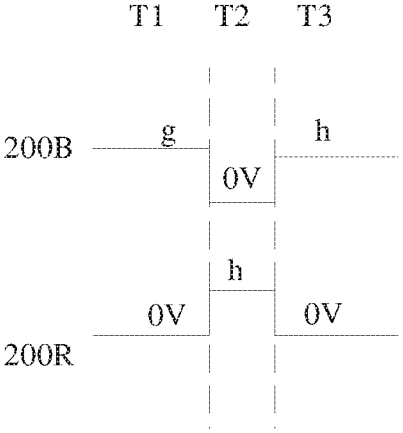
Figure 4A:
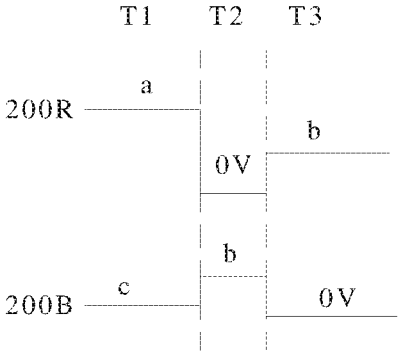
FIGS. 4(*a*) to 4(*d*) are timing diagrams of signals for testing a pixel unit in a display panel provided according to an embodiment of the present disclosure.
Figure 4B:
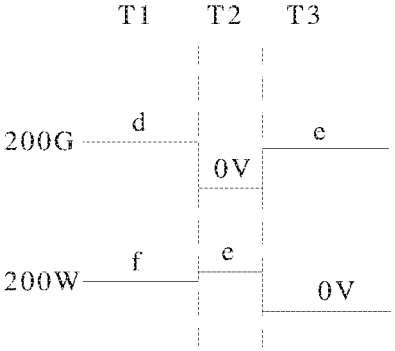
Figure 4C:
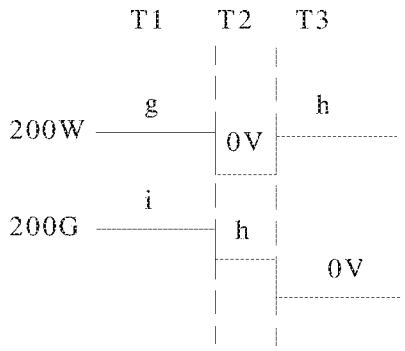
Figure 4D:
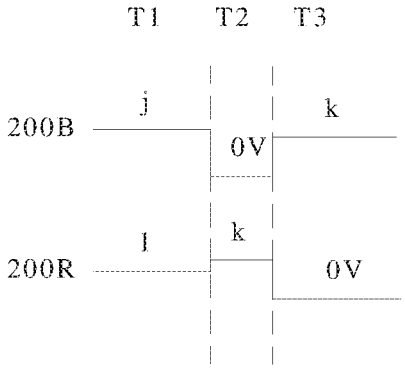

FIG. 2 illustrates a schematic diagram of a test signal line 10 having one second extending part, and a data line group corresponding thereto. The data line group includes four adjacent data lines. The test signal line 10 is located at a middle position of these four data lines. That is, two data lines are provided at each of two sides of the first extending part 130, and an orthographic projection of the first extending part 130 on the layer on which the data lines are located does not overlap with any data line.

As shown in FIG. 6, the first offset part 110 and the second offset part 120 of the test signal line 10 extend symmetrically at two sides of the first extending part 130, such that an orthographic projection of the first offset part 110 on the layer where the data lines are located has an overlapping region 1101 overlapping with the data line 200R, and an overlapping region 1103 overlapping with the data line 200G, and an orthographic projection of the second offset part 120 on the layer where the data lines are located has an overlapping region 1102 overlapping with the data line 200W, and an overlapping region 1104 overlapping with the data line 200B. Parasitic capacitances are generated at these overlapping regions of the test signal line 10 with the data lines.

It should be explained that, in the display panel provided by the present disclosure, a test is performed every predetermined time, and no test is performed during display. That is, test of the display panel includes multiple test cycles. A test time period is the time period when the test is performed in each test cycle. One test time period includes multiple test stages. In each test stage, one pixel unit may be tested. In one test time period, test of all pixel units in the display panel is completed.

An end of the test signal line 10 is electrically coupled to a test signal source, to supply the test signal line with an initial voltage.

When test is performed, a pixel unit to be tested needs to be initialized first. That is, a voltage on a data line corresponding to the pixel unit to be tested is changed from a value before test (for example, aV) to an initial value (for example, the initial voltage may be 0V). For ease of description, it is assumed that the data line corresponding to the pixel unit to be tested is located at a first side of the first extending part 130. In this process, a first offset voltage is applied to a data line (for ease of description, it is called an offset data line) which is in the same data line group as the data line corresponding to the pixel unit to be tested, and is located at a second side of the first extending part 130. In some embodiments, when the initialization is performed, when the voltage on the data line corresponding to the pixel unit to be tested changes from voltage of aV to the initial voltage of 0V, the voltage on the offset data line is changed from a voltage of initial state to a test voltage of bV. After the initialization, a test voltage (for example, test voltage of bV) is applied to the data line corresponding to the pixel unit to be tested, an initial voltage of 0V is applied to the offset data line.

Being in the same data line group, the data line corresponding to the pixel unit to be tested overlaps with the first offset part 110 to generate a first parasitic capacitance, and the corresponding offset data line overlaps with the second offset part 120 to generate a second parasitic capacitance. When the voltage on the data line corresponding to the pixel unit to be tested changes from the initial voltage of 0V to the test voltage of bV, the first parasitic capacitance will cause voltage increase on the test signal line 10; when the voltage on the offset data line changes from the test voltage of bV to the initial voltage of 0V, the second parasitic capacitance will cause voltage decrease on the test signal line 10. After the voltage increase and voltage decrease are offset, influence of voltage change of data lines on voltage signals output by the test signal line 10 can be reduced or even eliminated, thereby improving test accuracy. Since the voltage on the data line has a small influence on the voltage of the test signal line 10, time required to reset the test signal line 10 can be reduced.

In the present disclosure, each test time period may include multiple test stages, and in different test stages, different pixel units may be tested. For example, in one test time period, all pixel units corresponding to one data line group on the display panel may be tested one by one, then the number of test stages in one test time period equals the number of all pixel units corresponding to one data line group. Pixel units corresponding to data lines in different data line groups may be tested in parallel, then test of all pixel units on the display panel can be completed in only one test time period.

For example, adjacent data lines may be grouped according to colors of pixel units. For example, when the pixel units include a red pixel unit, a green pixel unit, and a blue pixel unit, six adjacent data lines may be grouped as one data line group. Similarly, when the pixel units include a red pixel unit, a green pixel unit, a blue pixel unit, and a white pixel unit, four adjacent data lines may be grouped as one data line group, as such, four data lines in one data line group are coupled to pixel unit columns of corresponding color, respectively. Obviously, an even number of adjacent data lines may also be grouped as a data line group according to other grouping methods, the present disclosure is not limited thereto.

When testing pixel units coupled to data lines in one data line group, the test voltage is applied to the data line of the data line group corresponding to the pixel unit to be tested, and an offset voltage is applied to the offset data line of the data line coupled to the pixel unit to be tested in the data line group at the other side of the first extending part, which can prevent the test voltage on the test signal line from being excessively affected by the voltage on the data lines, thereby obtaining a precise test result. Specifically, the data line, corresponding to the first offset part, coupled to the pixel unit to be tested is supplied with a voltage that causes the voltage on the test signal line to increase, and the offset data line corresponding to the second offset part is supplied with a voltage that causes the voltage on the test signal line to decrease, so as to offset influence of the voltage on the data lines to the output voltage on the test signal line.

According to an embodiment of the present disclosure, an overlapping region of each second extending part at the first side of the first extending part 130 has an area equal to an area of an overlapping region at a symmetrical position at the second side of the first extending part 130. As shown in FIG. 6, the area of the overlapping region 1101 is equal to the area of the overlapping region 1104, and the area of the overlapping region 1102 is equal to the area of the overlapping region 1103. As such, the data line 200W may serve as an offset data line of the data line 200G, and the data line 200B may serve as an offset data line of the data line 200R, and vice versa. If the overlapping regions have equal areas, then they generate equal parasitic capacitances.

According to an embodiment of the present disclosure, overlapping regions of each second extending part overlapping with data lines of the data line group have equal areas. As shown in FIG. 6, the overlapping region 1101, the overlapping region 1104, the overlapping region 1103, and the overlapping region 1102 all have equal areas. As such, any data line may serve as an offset data line of other data lines of the same data line group.

According to an embodiment of the present disclosure, the number of the plurality of second extending parts is the same as the number of the plurality of gate lines. That is, the number of the second extending parts is equal to the number of gate lines. For example, when the display panel has a resolution of 3840×2160, there may be provided 3840 second extending parts. Obviously, the number of the plurality of second extending parts may also be set to be smaller than the number of the plurality of gate lines, as such, along the extending direction of data lines, there may be provided a plurality of test signal lines, each test signal line may be used to test part rows of pixel units.

According to an embodiment of the present disclosure, to facilitate configuration and process, the plurality of second extending parts and the plurality of gate lines are provided at different layers of the display panel, and the plurality of second extending parts have orthographic projections on the layer where the plurality of gate lines are located which overlap with the plurality of gate lines in one-to-one correspondence. As such, the aperture ratio of the display panel can be increased.

Figure 5:
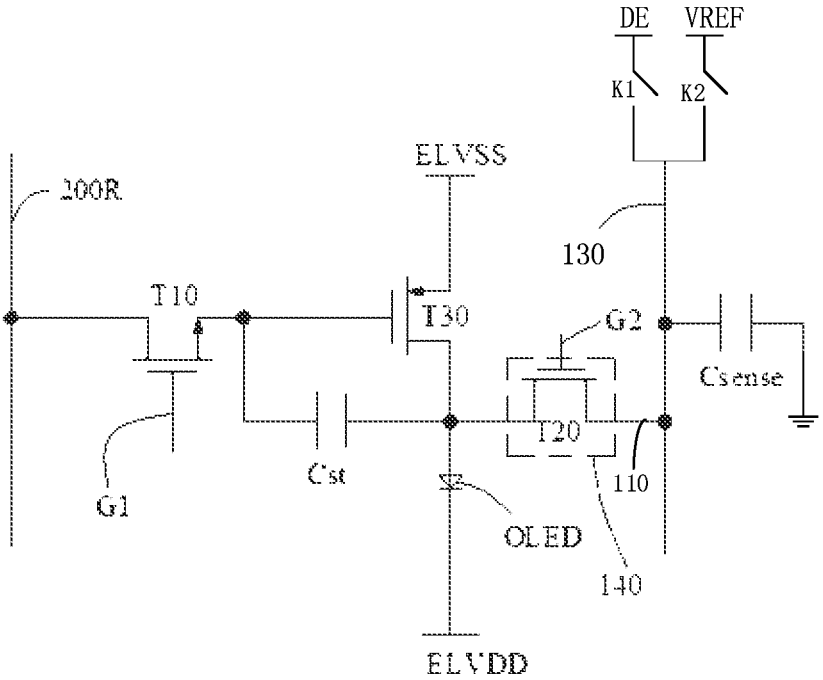
FIG. 5 is a schematic diagram showing connection relationship between a compensation circuit and a test signal line in a display panel provided according to an embodiment of the present disclosure.

According to an embodiment of the present disclosure, as shown in FIG. 5, the display panel may further include a plurality of test scan lines G2 and a plurality of test switch circuits 140 arranged in rows and columns and provided in one-to-one correspondence with the plurality of pixel units. The plurality of test scan lines G2 are arranged parallel to the plurality of gate lines G1 and one test scan line G2 is configured to drive a row of test switch circuits 140. In this arrangement, the test switch circuit 140 is electrically coupled to a corresponding test scan line G2, an anode of an OLED in a corresponding pixel unit, and the test signal line 10 corresponding to the data line group to which the data line of the corresponding pixel unit belongs.

Specifically, one pixel unit corresponds to one test switch circuit, such that the test switch circuits 140 are arranged in rows and columns And, rows of test switch circuits 140 correspond to the plurality of test scan lines G2 in one-to-one relationship, and test switch circuits 140 corresponding to pixel units coupled to data lines in one data line group are coupled to a second extending part of one test signal line 10.

Each of the test switch circuits 140 includes a control terminal, an input terminal, and an output terminal. The control terminal of the test switch circuit 140 is coupled to a corresponding test scan line G2, the input terminal of the test switch circuit 140 is coupled to an anode of an OLED of a corresponding pixel unit, the output terminal of the test switch circuit 140 is coupled to an offset part (the first offset part 110 shown in FIG. 5) of a second extending part of a corresponding test signal line 10.

When the control terminal of the test switch circuit 140 receives a test scan signal, the test switch circuit 140 is turned on, so that an offset part (the first offset part 110 shown in FIG. 5) of the second extending part of the test signal line 10 is electrically coupled to the anode of the OLED in the pixel unit.

It is readily understood that, it is only when the display panel needs to be tested that the control terminal of the test switch circuit 140 is supplied with a first test control signal (test scan signal). To facilitate test of each pixel unit, the plurality of test scan lines G2 need to be scanned row by row. When a signal on the test scan line G2 is a second test control signal, the test switch circuit 140 does not operate, the test signal line 10 is disconnected with the anode of the OLED in the pixel unit.

In order to simplify the structure of the test switch circuit 140, according to an embodiment of the present disclosure, the test switch circuit 140 includes a test switch transistor T20, a gate of the test switch transistor T20 corresponds to the control terminal of the test switch circuit 140, a first electrode of the test switch transistor T20 corresponds to the input terminal of the test switch circuit 140, a second electrode of the test switch transistor T20 corresponds to the output terminal of the test switch circuit 140. Specifically, the first electrode of the test switch transistor T20 is coupled to a first offset part 110 of a second extending part of a corresponding test signal line 10, the second electrode of the test switch transistor T20 is coupled to an anode of an OLED of a corresponding pixel unit, and the gate of the test switch transistor T20 is coupled to a corresponding test scan line G2.

The first electrode of the test switch transistor T20 and the second electrode of the test switch transistor T20 connect when the gate of the test switch transistor T20 receives a first test control signal, and the first electrode of the test switch transistor T20 and the second electrode of the test switch transistor T20 disconnect when the gate of the test switch transistor T20 receives a second test control signal. The first test control signal and the second test control signal have opposite phases.

In order to drive the OLED to emit light, each pixel unit should be provided with a compensation circuit. According to an embodiment of the present disclosure, as shown in FIG. 5, the compensation circuit includes a data switch transistor T10, a drive transistor T30, a storage capacitor Cst, a first electric level signal terminal ELVSS and a second electric level signal terminal ELVDD.

A first electrode of the data switch transistor T10 is coupled to a data line corresponding to the pixel unit to which it belongs, a gate of the data switch transistor T10 is coupled to the gate line G1 corresponding to the pixel unit to which it belongs, and a second electrode of the data switch transistor T10 is electrically coupled to a gate of the drive transistor T30 and a first terminal of the storage capacitor Cst. The first electrode of the data switch transistor T10 and the second electrode of the data switch transistor T10 connect when the gate of the data switch transistor T10 receives a first scan signal (gate signal), and the first electrode of the data switch transistor T10 and the second electrode of the data switch transistor T10 disconnect when the gate of the data switch transistor T10 receives a second scan signal. The first scan signal and the second scan signal have opposite phases.

A first electrode of the drive transistor T30 is electrically coupled to the first electric level signal terminal ELVSS, a second electrode of the drive transistor T30 is electrically coupled to the anode of the OLED of the pixel unit to which it belongs and a second terminal of the storage capacitor Cst. It is readily understood that a cathode of the OLED is electrically coupled to the second electric level signal terminal ELVDD.

The first terminal of the storage capacitor Cst is electrically coupled to the gate of the drive transistor T30 in the pixel unit to which it belongs, the second terminal of the storage capacitor Cst is electrically coupled to the anode of the OLED of the pixel unit to which it belongs.

When the first electrode and the second electrode of the data switch transistor T10 connect, a data voltage will be applied to the gate of the drive transistor T30. Meanwhile, the storage capacitor Cst is coupled to the second electrode of the data switch transistor T10 to store electric energy, and when the data switch transistor T10 is turned off, the storage capacitor Cst keeps the drive transistor T30 being turned on so that the voltage applied by the first electric level signal terminal ELVSS drives the OLED to emit light.

The above-described compensation circuit has a simple structure, and more compensation circuits may be disposed in one display panel, to improve the resolution of the display panel. In the present disclosure, compensating for a pixel unit is essentially compensating for a threshold voltage of the drive transistor in the compensation circuit.

According to an embodiment of the present disclosure, the display device further includes a plurality of sensing capacitors, the plurality of sensing capacitors are provided in one-to-one correspondence with the plurality of test signal lines, a first terminal of the sensing capacitor is coupled to a corresponding test signal line, and a second terminal of the sensing capacitor is grounded. As shown in FIG. 5, the first terminal of the sensing capacitor Csense is coupled to the corresponding test signal line 10, the second terminal of the sensing capacitor Csense is grounded. Electric energy is stored by the sensing capacitor Csense, which can obtain an anode voltage of the OLED when testing the pixel unit.

According to an embodiment of the present disclosure, the number of the plurality second extending parts is equal to the number of the plurality of test scan lines G2. That is, the number of the plurality of second extending parts, the number of the plurality of test scan lines G2 and the number of the plurality of gate lines are equal.

According to an embodiment of the present disclosure, the plurality of second extending parts are provided at a different layer of the display panel than the plurality of test scan lines G2, and orthographic projections of the plurality of second extending parts on the layer where the plurality of test scan lines G2 are located overlap with the plurality of test scan lines G2 in one-to-one correspondence. That is, the plurality of second extending parts are arranged to overlap with the plurality of test scan lines G2 in one-to-one correspondence, to increase the aperture ratio of the display panel.

According to a second aspect of the present disclosure, a testing method for testing a display panel is provided, in which the display panel is the above display panel provided by the present disclosure.

Figure 7:
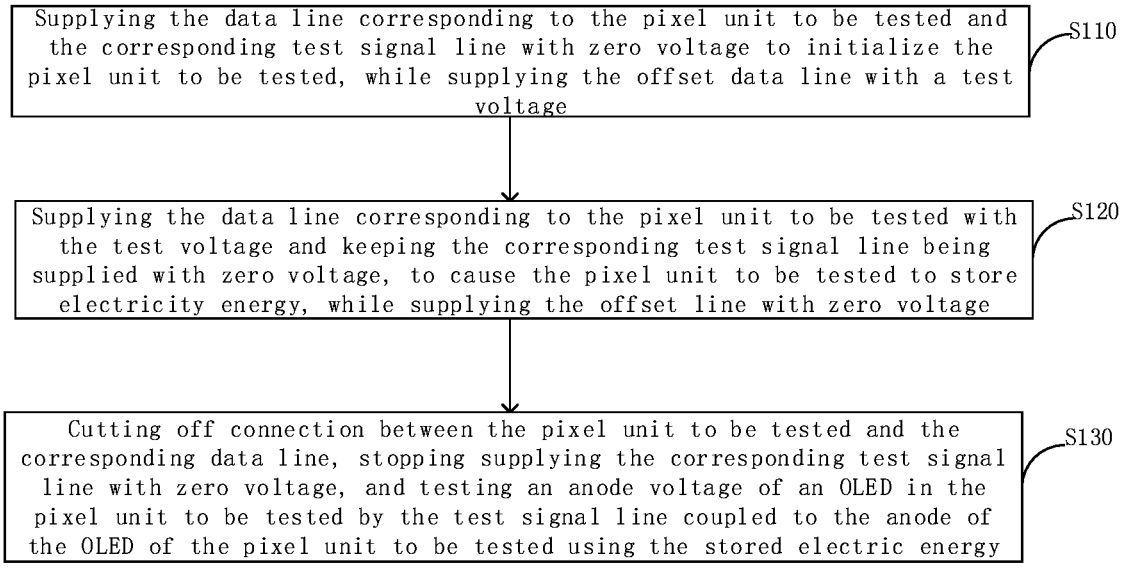
FIG. 7 is a flow chart illustrating a method for testing a pixel unit in a display panel provided according to an embodiment of the present disclosure.
Figure 8A:
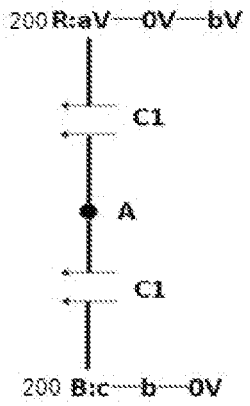
FIGS. 8(*a*) to 8(*d*) are equivalent circuit diagrams of parasitic capacitances illustrating voltage offsets in the display panel according to an embodiment of the present disclosure.
Figure 8B:
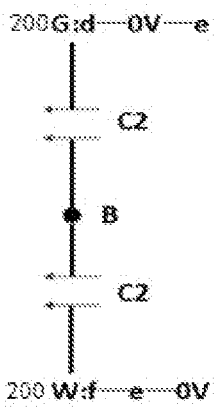
Figure 8C:
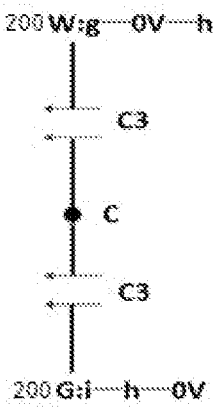
Figure 8D:
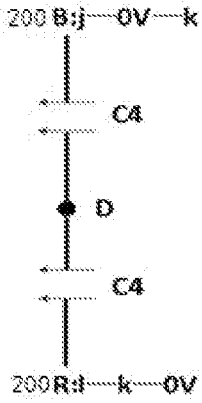

The testing method includes a plurality of test cycles, a test time period of each test cycle includes a plurality of test stages, the plurality of test stages test, in one-to-one correspondence, respective ones of pixel units corresponding to data lines in the data line group. In each test stage, an anode of an OLED in a pixel unit to be tested is kept being electrically coupled to a corresponding test signal line, data lines in the data line group except for a data line corresponding to the pixel unit to be tested and an offset data line are kept being supplied with zero voltage, and the offset data line is a data line in the data line group arranged for offsetting a voltage on the data line corresponding to the pixel unit to be tested. As shown in FIG. 7, each test stage includes a first initialization sub-stage, a second initialization sub-stage, and a test sub-stage.

In step S110, that is, in the first initialization sub-stage, the data line corresponding to the pixel unit to be tested and the corresponding test signal line are supplied with zero voltage to initialize the pixel unit to be tested, while supplying the offset data line with a test voltage.

In step S120, that is, in the second initialization sub-stage, the data line corresponding to the pixel unit to be tested is supplied with the test voltage and the corresponding test signal line is kept being supplied with zero voltage while storing electric energy, while supplying the offset data line with zero voltage.

In step S130, that is, in the test sub-stage, connection between the pixel unit to be tested and the corresponding data line is cut off, the corresponding test signal line is cut off from supplying with zero voltage, and an anode voltage of the OLED in the pixel unit to be tested is tested using the stored electric energy, by the test signal line coupled to the anode of the OLED of the pixel unit to be tested.

According to a specific embodiment of the present disclosure, when an overlapping region of each second extending part at the first side of the first extending part 130 has an area equal to an area of an overlapping region at a symmetrical position at the second side of the first extending part 130, the offset data line is a data line in the data line group located at a symmetrical position of the data line corresponding to the pixel unit to be tested with respect to the first extending part of the test signal line corresponding to the data line group. For example, the offset data line of the data line 200R is the data line 200B.

According to a specific embodiment of the present disclosure, when overlapping regions of each second extending part overlapping with data lines of the data line group have equal areas, the offset data line is any data line in the data line group other than the data line corresponding to the pixel unit to be tested, for example, the offset data line of the data line 200R may be any one of the data line 200B, the data line 200W and the data line 200G In the present disclosure, description is given for an example in which the offset data line is the data line at a symmetrical position about the first extending part of the test signal line.

The testing method of the display panel provided by the present disclosure is described in detail below in conjunction with FIGS. 2, 5, 3(*a*)-3(*d*), 8(*a*)-8(*d*).

In the embodiment shown in FIG. 2, pixel units on the display panel include a red pixel unit, a green pixel unit, a blue pixel unit and a white pixel unit, corresponding to data lines 200R, 200G, 200B, and 200W, respectively. Data line 200R and data line 200G are on the left side of the first extending part 130 of the test signal line 10, and the first offset part 110 intersects with the data line 200R and the data line 200G to form overlapping regions 1101 and 1103. Data line 200W and data line 200B are on the right side of the first extending part 130 of the test signal line 10, and the second offset part 120 intersects with data line 200W and data line 200B to form overlapping regions 1102 and 1104.

FIG. 3(*a*) illustrates a signal timing diagram when a red pixel unit is tested. Stage T1 is an initial state of the corresponding data line 200R with a voltage of aV. Referring to FIGS. 3(*a*) and 5, in the first initialization sub-stage T2, the data line 200R corresponding to the red pixel unit to be tested is supplied with zero voltage, the offset data line 200B in the data line group is supplied with the test voltage of bV, and data lines in the data line group except for the data line corresponding to the pixel unit to be tested and the offset data line (data line 200G and data line 200W) are supplied with zero voltage. Meanwhile, the gate line G1 is supplied with a gate signal, the test scan line G2 is supplied with a test scan signal, the test signal line 10 is supplied with zero voltage. At this time, the data switch transistor T10 and the test switch transistor T20 are both turned on, so that voltages at both terminals of the storage capacitor Cst are 0V, so as to achieve initialization of the pixel unit to be tested.

In the second initialization sub-stage T3, the gate line G1 is kept being supplied with the gate signal, the test scan line G2 is kept being supplied with the test scan signal, the test signal line 10 is kept being supplied with zero voltage, while the data line 200R corresponding to the red pixel unit to be tested is supplied with the test voltage of bV, the offset data line 200B is supplied with zero voltage. Thus, the data switch transistor T10 and the test switch transistor T20 are both turned on, so that a voltage difference between two terminals of the storage capacitor Cst (a first terminal of which is at the test voltage of bV, a second terminal is at zero voltage) appears, and the storage capacitor Cst stores electric energy.

When moving into the second initialization sub-stage T3 from the first initialization sub-stage T2, the voltage on the data line 200R is changed from 0V to the test voltage of bV, the voltage on the offset data line 200B is changed from the test voltage of bV to 0V. Because the overlapping area 1101 of the first offset part 110 with the data line 200R is equal to the overlapping area 1104 of the second offset part 120 with the data line 200B, parasitic capacitances having equal capacity are generated at the overlapping area 1101 and the overlapping area 1104. In the meantime, the equivalent circuit diagram of parasitic capacitances illustrating voltage offset is shown in FIG. 8(*a*).

When the voltage on the data line 200R is changed from 0V to the test voltage of bV, the parasitic capacitance generated by overlapping of the data line 200R with the first offset part 110 may cause the voltage on the test signal line 10 to increase, while the voltage on the data line 200B is changed from the test voltage of bV to 0V, the parasitic capacitance generated by overlapping of the data line 200B with the second offset part 120 may cause the voltage on the test signal line 10 to decrease. The voltage increase is offset by the voltage decrease, which can reduce or eliminate influence of the voltage of data line on the voltage output by the test signal line 10.

In the test sub-stage, the test scan line G2 is kept being supplied with the test scan signal, the gate line G1 is cut off from supplying with the gate signal, and the test signal line 10 is cut off from supplying with zero voltage. At this time, the data switch transistor T10 is turned off, the test switch transistor T20 is turned on, the drive transistor T30 is kept being turned on by the electric energy stored by the storage capacitor Cst to drive the OLED to emit light, and at the same time the sensing capacitor Csense stores electric energy, to facilitate obtain the anode voltage of the OLED.

After the test stage finishes, the test scan line G2 is cut off from supplying with the test scan signal, the test signal line 10 is thus disconnected with the OLED, in the meantime, a voltage at a connection point between the sensing capacitor Csense and the test signal line 10 will be tested. Compensation is performed for the pixel unit based on the tested voltage.

FIG. 3(*b*) illustrates a signal timing diagram when a green pixel unit is tested. As an embodiment, the difference from the above-described test of a red pixel unit lies in that, in the first initialization sub-stage T2, the data line 200G corresponding to the green pixel unit is supplied with zero voltage, the data line 200W corresponding to the white pixel unit is supplied with a test voltage of dV; in the second initialization sub-stage T3, the data line 200G corresponding to the green pixel unit is supplied with the test voltage of dV, the data line 200W corresponding to the white pixel unit is supplied with zero voltage. In the meantime, the equivalent circuit diagram of parasitic capacitances illustrating voltage offset is shown in FIG. 8(*b*).

FIG. 3(*c*) illustrates a signal timing diagram when a white pixel unit is tested. As an embodiment, the difference from the above-described test of a red pixel unit lies in that, in the first initialization sub-stage T2, the data line 200W corresponding to the white pixel unit is supplied with zero voltage, the data line 200G corresponding to the green pixel unit is supplied with a test voltage of fV; in the second initialization sub-stage T3, the data line 200W corresponding to the white pixel unit is supplied with the test voltage of fV, the data line 200G corresponding to the green pixel unit is supplied with zero voltage. In the meantime, the equivalent circuit diagram of parasitic capacitances illustrating voltage offset is shown in FIG. 8(*c*).

FIG. 3(*d*) illustrates a signal timing diagram when a blue pixel unit is tested. As an embodiment, the difference from the above-described test of a red pixel unit lies in that, in the first initialization sub-stage T2, the data line 200B corresponding to the blue pixel unit is supplied with zero voltage, the data line 200R corresponding to the red pixel unit is supplied with a test voltage of hV; in the second initialization sub-stage T3, the data line 200B corresponding to the blue pixel unit is supplied with the test voltage of hV, the data line 200R corresponding to the red pixel unit is supplied with zero voltage. In the meantime, the equivalent circuit diagram of parasitic capacitances illustrating voltage offset is shown in FIG. 8(*d*).

FIGS. 4(*a*) to 4(*d*) illustrate signal timing diagrams when testing a red pixel unit (FIG. 4(*a*)), a green pixel unit (FIG. 4(*b*)), a blue pixel unit (FIG. 4(*c*)), a white pixel unit (FIG. 4(*d*)) according to another embodiment of the present disclosure. The difference from FIGS. 3(*a*) to 3(*d*) lies in that test voltages and initial voltages are different but sharing the same test principle as above, description of which is omitted herein.

Figure 9:
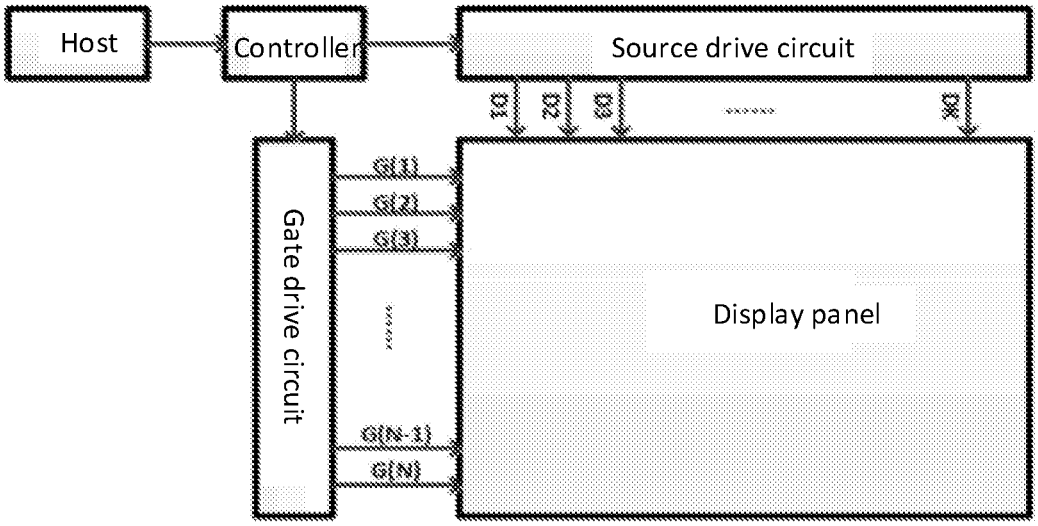
FIG. 9 is a schematic diagram of a display device provided according to an embodiment of the present disclosure.

As a third aspect of the present disclosure, a display device including a display panel is provided. The display panel is the above-described display panel provided by the present disclosure. The display device further includes a source drive circuit, a gate drive circuit, and a controller, as shown in FIG. 9. The controller is electrically coupled to the plurality of test signal lines, the source drive circuit and the gate drive circuit. The source drive circuit is coupled to the plurality of pixel units on the display panel in one-to-one correspondence, via the plurality of data lines D1, D2, D3 . . . DK. The gate drive circuit is coupled to the plurality of pixel units on the display panel in one-to-one correspondence, via the plurality of gate lines G(1), G(2), G(3) . . . G(N−1), G(N). The controller may compute a compensation signal based on the test signal output by the test signal line, and then may provide the compensation signal to the source drive circuit. The source drive circuit, under the control of the controller, supplies display units of the display panel with the compensated data signal via the plurality of data lines. The gate drive circuit, under the control of the controller, supplies display units of the display panel with the gate signal via the plurality of gate lines.

According to an embodiment of the present disclosure, the display device further includes a tester DE and a first switch K1. The tester DE is coupled to the plurality of test signal lines 10 via the first switch K1, and meanwhile the tester DE is also coupled to the controller (not illustrated in figures). When the first switch K1 is turned off, the tester DE tests the voltage of the sensing capacitor Csense, and sends the tested voltage to the controller for computing the compensation signal.

According to an embodiment of the present disclosure, the display device further includes a test signal source VREF and a second switch K2. The test signal source VREF is coupled to the plurality of test signal lines 10 via the second switch K2. When the second switch K2 is turned off, the test signal source VREF may supply the plurality of test signal lines 10 with an initial voltage.

The display device of the present disclosure can prevent the test voltage on the test signal line from being overly affected by the voltage on the data line, thereby obtaining a precise test result, and reducing time required to reset the test signal line.

It should be understood that, the above embodiments are only exemplary embodiments for the purpose of explaining the principle of the present disclosure, and the present disclosure is not limited thereto. For one of ordinary skill in the art, various modifications and variations may be made without departing from the spirit and essence of the present disclosure. These modifications and variations also fall within the protection scope of the present disclosure.

What is claimed is:

1. A display panel, comprising a plurality of gate lines, a plurality of data lines, a plurality of test signal lines, and a plurality of pixel units, wherein the plurality of pixel units are provided in regions arranged in rows and columns formed by intercrossing of the plurality of gate lines and the plurality of data lines, and each of the plurality of pixel units comprises an organic light emitting diode (OLED), wherein an even number of adjacent data lines among the plurality of data lines are grouped as a data line group such that the plurality of data lines are grouped as a plurality of data line groups, one test signal line is provided at a middle position of the data line group such that the numbers of data lines at both sides of the test signal line are same, the plurality of test signal lines are provided at a different layer of the display panel than the plurality of data lines, and the plurality of data line groups are in one-to-one correspondence with the plurality of test signal lines, each of the plurality of test signal lines comprises one first extending part and a plurality of second extending parts coupled to the first extending part;

the first extending part extends along a first direction parallel to the plurality of data lines;

each of the second extending parts extends symmetrically at both sides of the first extending part along a second direction perpendicular to the first direction, to electrically connect to anodes of OLEDs of a row of pixel units corresponding to the data line group, and an orthographic projection of each of the second extending parts on a layer where the plurality of data lines are located has overlapping regions that overlap with each data line in the data line group.

2. The display panel according to claim 1, wherein an overlapping region of each second extending part at a first side of the first extending part has an area equal to an area of an overlapping region at a symmetrical position at a second side of the first extending part.

3. The display panel according to claim 2, wherein the overlapping regions of each second extending part overlapping with data lines of the data line group have equal areas.

4. The display panel according to claim 2, wherein the number of the plurality of second extending parts is equal to the number of the plurality of gate lines.

5. The display panel according to claim 4, wherein the plurality of second extending parts and the plurality of gate lines are provided at different layers of the display panel, and the plurality of second extending parts have orthographic projections on the layer where the plurality of gate lines are located which overlap with the plurality of gate lines in one-to-one correspondence.

6. The display panel according to claim 1, further comprising a plurality of test scan lines and a plurality of test switch circuits arranged in rows and columns and provided in one-to-one correspondence with the plurality of pixel units, wherein the plurality of test scan lines are arranged parallel to the plurality of gate lines and one test scan line is configured to drive a row of test switch circuits, wherein each of the test switch circuits comprises a control terminal, an input terminal, and an output terminal, the control terminal of the test switch circuit is electrically coupled to a corresponding test scan line, the input terminal of the test switch circuit is electrically coupled to an anode of an OLED of a corresponding pixel unit, and the output terminal of the test switch circuit is electrically coupled to a second extending part of a test signal line corresponding to a data line group to which a data line coupled to the corresponding pixel unit belongs.

7. The display panel according to claim 6, wherein each of the test switch circuits comprises a test switch transistor, a first electrode of the test switch transistor corresponds to the output terminal and is coupled to the second extending part of the corresponding test signal line, a second electrode of the test switch transistor corresponds to the input terminal and is coupled to the anode of the OLED of the corresponding pixel unit, and a gate of the test switch transistor corresponds to the control terminal and is coupled to the corresponding test scan line.

8. The display panel according to claim 7, further comprising a plurality of sensing capacitors, wherein the plurality of sensing capacitors are provided in one-to-one correspondence with the plurality of test signal lines, and a first terminal of the sensing capacitor is coupled to the corresponding test signal line, and a second terminal of the sensing capacitor is grounded.

9. The display panel according to claim 8, wherein each of the pixel units is provided with a compensation circuit, which comprises a data switch transistor, a drive transistor, a storage capacitor, a first electric level signal terminal and a second electric level signal terminal, a first electrode of the data switch transistor is coupled to a data line corresponding to a pixel unit to which it belongs, a gate of the data switch transistor is coupled to a gate line corresponding to the pixel unit to which it belongs, and a second electrode of the data switch transistor is coupled to a gate of the drive transistor and a first terminal of the storage capacitor;

a first electrode of the drive transistor is coupled to the first electric level signal terminal, a second electrode of the drive transistor is coupled to an anode of an OLED of the pixel unit to which it belongs and a second terminal of the storage capacitor; and the second electric level signal terminal is coupled to a cathode of the OLED.

10. The display panel according to claim 6, wherein the number of the plurality second extending parts is equal to the number of the plurality of test scan lines, the plurality of second extending parts are provided at a different layer of the display panel than the plurality of test scan lines, and orthographic projections of the plurality of second extending parts on a layer where the plurality of test scan lines are located overlap with the plurality of test scan lines in one-to-one correspondence.

11. The display panel according to claim 1, wherein the plurality of data lines are grouped according to colors of the pixel units.

12. The display panel according to claim 11, wherein the pixel units comprise a red pixel unit, a green pixel unit, a blue pixel unit, and a white pixel unit, which are coupled to four data lines in one data line group, respectively.

13. A display device, comprising the display panel according to claim 1, the display device further comprising a source drive circuit, a gate drive circuit, and a controller, wherein the controller is electrically coupled to the plurality of test signal lines, the source drive circuit and the gate drive circuit;

the source drive circuit is coupled to the plurality of pixel units on the display panel via the plurality of data lines;

the gate drive circuit is coupled to the plurality of pixel units on the display panel via the plurality of gate lines.

14. The display device according to claim 13, further comprising a tester and a first switch, wherein the tester is coupled to first extending parts of the plurality of test signal lines via the first switch, and the tester is further coupled to the controller.

15. The display device according to claim 14, further comprising a test signal source and a second switch, wherein the test signal source is coupled to the first extending parts of the plurality of test signal lines via the second switch.

16. A testing method of a display panel, wherein the display panel comprises: a plurality of gate lines, a plurality of data lines, a plurality of test signal lines, and a plurality of pixel units, wherein the plurality of pixel units are provided in regions arranged in rows and columns formed by intercrossing of the plurality of gate lines and the plurality of data lines, and each of the plurality of pixel units comprises an organic light emitting diode (OLED), wherein an even number of adjacent data lines among the plurality of data lines are grouped as a data line group such that the plurality of data lines are grouped as a plurality of data line groups, one test signal line is provided at a middle position of the data line group such that the numbers of data lines at both sides of the test signal line are same, the plurality of test signal lines are provided at a different layer of the display panel than the plurality of data lines, and the plurality of data line groups are in one-to-one correspondence with the plurality of test signal lines, each of the plurality of test signal lines comprises one first extending part and a plurality of second extending parts coupled to the first extending part;

the first extending part extends along a first direction parallel to the plurality of data lines;

each of the second extending parts extends symmetrically at both sides of the first extending part along a second direction perpendicular to the first direction, to electrically connect to anodes of OLEDs of a row of pixel units corresponding to the data line group, and an orthographic projection of each of the second extending parts on a layer where the plurality of data lines are located has overlapping regions that overlap with each data line in the data line group, the testing method comprises a plurality of test cycles, a test time period of each of the test cycles comprises a plurality of test stages, the plurality of test stages test, in one-to-one correspondence, respective ones of pixel units corresponding to data lines in the data line group, wherein, in each test stage, an anode of an OLED in a pixel unit to be tested is kept being electrically coupled to a corresponding test signal line, data lines in the data line group except for both a data line corresponding to the pixel unit to be tested and an offset data line are kept being supplied with zero voltage, wherein the offset data line is a data line in the data line group used for offsetting a voltage on the data line corresponding to the pixel unit to be tested, each of the test stages comprises:

a first initialization sub-stage: supplying the data line corresponding to the pixel unit to be tested and the corresponding test signal line with zero voltage to initialize the pixel unit to be tested, while supplying the offset data line with a test voltage;

a second initialization sub-stage: supplying the data line corresponding to the pixel unit to be tested with the test voltage and keeping the corresponding test signal line being supplied with zero voltage while storing electric energy, while supplying the offset data line with zero voltage;

a test sub-stage: cutting off connection between the pixel unit to be tested and the corresponding data line, stopping the corresponding test signal line being supplied with zero voltage, and testing a voltage at the anode of the OLED in the pixel unit to be tested by the test signal line coupled to the anode of the OLED of the pixel unit to be tested using the stored electric energy.

17. The testing method according to claim 16, wherein, an overlapping region of each second extending part at a first side of the first extending part has an area equal to an area of an overlapping region at a symmetrical position at a second side of the first extending part, and the offset data line is a data line in the data line group located at a symmetrical position of the data line corresponding to the pixel unit to be tested with respect to the first extending part of the test signal line corresponding to the data line group.

18. The testing method according to claim 16, wherein, overlapping regions of each second extending part overlapping with data lines of the data line group have equal areas, and the offset data line is any data line in the data line group other than the data line corresponding to the pixel unit to be tested.

* * * * *